US009587638B2

(12) United States Patent
Hoppach et al.

(10) Patent No.: US 9,587,638 B2
(45) Date of Patent: Mar. 7, 2017

(54) DRIVE UNIT FOR A SUBMERSIBLE OIL PUMP, WITH A FLUID PASSAGE ALLOWING THE FLUID IN THE MOTOR HOUSING TO BE DISCHARGED TO THE AMBIENT ENVIROMENT

(75) Inventors: Elmar Hoppach, Bad Homburg (DE); Kai Lunau, Ober-Moerlen (DE); Andreas Bernert, Bad Homburg (DE)

(73) Assignee: Magna Powertrain Bad Homburg GmbH, Bad Homburg (DE)

( * ) Notice: Subject to any disclaimer, the term of this patent is extended or adjusted under 35 U.S.C. 154(b) by 300 days.

(21) Appl. No.: 14/004,061

(22) PCT Filed: Mar. 13, 2012

(86) PCT No.: PCT/DE2012/100064

§ 371 (c)(1),
(2), (4) Date: Sep. 9, 2013

(87) PCT Pub. No.: WO2012/130225

PCT Pub. Date: Oct. 4, 2012

(65) Prior Publication Data

US 2015/0184659 A1 Jul. 2, 2015

(30) Foreign Application Priority Data

Mar. 31, 2011 (DE) ..... 10 2011 001 700

(51) Int. Cl.

| | |
|---|---|
| ***F04D 13/08*** | (2006.01) |
| ***F04C 11/00*** | (2006.01) |
| ***F04C 15/00*** | (2006.01) |
| ***F04C 13/00*** | (2006.01) |
| ***F04C 2/10*** | (2006.01) |

(52) U.S. Cl.
CPC ..... *F04D 13/086* (2013.01); *F04C 11/008* (2013.01); *F04C 13/008* (2013.01);
(Continued)

(58) Field of Classification Search
CPC .... F04D 13/086; F04D 13/08; F04D 13/0653; F04D 29/5806; F04D 29/5813;
(Continued)

(56) References Cited

U.S. PATENT DOCUMENTS 3,117,526 A * 1/1964 Zimmermann ..... H02K 5/132 310/172
6,183,208 B1 * 2/2001 Qandil ..... F04D 13/08 310/54

(Continued)

FOREIGN PATENT DOCUMENTS

CN 86105344 A 4/1987
CN 101117938 A 2/2008

(Continued)

*Primary Examiner* — William H Rodriguez
*Assistant Examiner* — Christopher Brunjes
(74) *Attorney, Agent, or Firm* — Davidson, Davidson & Kappel, LLC

(57) ABSTRACT

A drive unit (3) for a submersible oil pump, including a housing (7), a motor compartment (9) that is surrounded by the housing (7), and a rotor (13) arranged in the motor compartment (9), whereby a first fluid path (35) leading from a submerged oil environment (37) of the housing (7) to the motor compartment (9) is provided so as to allow oil to flow from the submerged oil environment (37) into the motor compartment (9).

10 Claims, 2 Drawing Sheets

(52) U.S. Cl.
CPC ..... *F04C 15/008* (2013.01); *F04C 2/10* (2013.01); *F04C 2270/701* (2013.01)

(58) Field of Classification Search
CPC .... F04D 29/586; F04D 29/588; F04C 15/008; F04C 13/008; F04C 11/008; F04C 2/10; F04C 2270/71; F04C 29/0085; F04C 29/04; F04B 53/08; F04B 39/06; H02K 5/12; H02K 5/132; H02K 9/00; H02K 9/005
USPC ..... 310/87, 54, 58, 59
See application file for complete search history.

(56) References Cited

U.S. PATENT DOCUMENTS

| | | | | |
|---|---|---|---|---|
| 6,468,058 | B1 * | 10/2002 | Breit | F04C 13/008 417/423.3 |
| 2005/0053494 | A1 | 3/2005 | Andrews | |
| 2006/0182627 | A1 * | 8/2006 | Tibban | F04D 9/007 415/206 |
| 2006/0216181 | A1 | 9/2006 | Yanagisawa et al. | |
| 2008/0038126 | A1 * | 2/2008 | Berroth | F04D 13/14 417/420 |
| 2008/0067116 | A1 * | 3/2008 | Anderson | E21B 47/042 210/100 |
| 2008/0273990 | A1 * | 11/2008 | Pham | F04D 17/122 417/53 |

FOREIGN PATENT DOCUMENTS

| | | | |
|---|---|---|---|
| DE | 4433448 | A1 | 3/1996 |
| DE | 10208688 | A1 | 9/2003 |
| EP | 0227880 | A1 | 7/1987 |
| EP | 0730094 | A1 | 9/1996 |
| EP | 0990800 | A1 | 4/2000 |
| JP | 2011052682 | A | 3/2011 |

* cited by examiner

DRIVE UNIT FOR A SUBMERSIBLE OIL PUMP, WITH A FLUID PASSAGE ALLOWING THE FLUID IN THE MOTOR HOUSING TO BE DISCHARGED TO THE AMBIENT ENVIROMENT

The invention relates to a drive unit for a submersible oil pump as well as to a pump, especially a submersible oil pump.

BACKGROUND

Drive units and pumps of the type mentioned here are already known. The drive units serve to drive so-called submersible oil pumps that are employed to convey oil, for instance, transmission oil. In this context, the pump, together with the preferably integrated drive unit, is completely or partially submerged in a reservoir containing the oil that is to be pumped. Prior-art drive units have a housing that surrounds a motor compartment. A rotor is arranged in this compartment. The rotor ultimately serves as the rotary drive of the pump unit in that it is joined to it by a drive shaft. A first fluid path leading from a submerged oil environment of the housing to the motor compartment is provided so as to cool the drive unit that heats up during the pumping operation. Since the pump is completely or partially submerged in the oil that it has to convey, the environment of the housing contains oil that can get into the motor compartment via the first fluid path, thereby cooling the drive unit. A drawback of prior-art drive units is that, especially during standstill phases, they fill up with oil via the first fluid path, so that a considerable portion or even the entire motor compartment is flooded with oil. When the pump is started up again as well as during operation, so-called splash losses occur since the rotor has to rotate in the oil that is present in the motor compartment, a process in which a drag torque acts upon it.

SUMMARY OF THE INVENTION

It is an object to the present invention is to provide a drive unit and a pump that do not entail the above-mentioned drawbacks.

The present invention provides a drive unit characterized by at least a second fluid path that leads from the motor compartment to the air environment of the housing and that allows oil to be expelled from the motor compartment by the rotor. The air environment is located, at least partially, above the oil surface below which the pump is at least partially arranged. The second fluid path is provided on the drive unit in such a manner that oil that is accelerated by the rotational movement of the rotor when it starts up is then expelled from the motor compartment. Especially oil that is adhering to the rotor is appropriately accelerated and ultimately expelled. But even oil that is not adhering directly to the rotor, but rather, that is located in its vicinity, can be picked up, accelerated and expelled. In this manner, a considerable portion of the oil is conveyed out of the motor compartment, thus minimizing splash losses.

Preferably, a drive unit is provided in which the second fluid path comprises a discharge opening that is arranged in a circumferential wall of the housing. This has the advantage that the oil accelerated by the rotor can be expelled very efficiently. The second fluid path can preferably comprise a snorkel whenever the discharge opening is arranged below the oil surface. The snorkel protrudes above the oil surface into the air environment.

Special preference is also given to a drive unit in which the discharge opening has a passage surface that is arranged essentially perpendicular to an imaginary circumferential line in a direction of rotation of the rotor. The oil that is accelerated by the rotor has a main velocity component that is oriented tangentially to the direction of rotation of the rotor. If the passage surface of the discharge opening is oriented essentially perpendicular to an imaginary circumferential line in the direction of rotation of the rotor, then the main velocity component is essentially perpendicular to the passage surface. This allows the accelerated oil to exit with no resistance, a process in which it is expelled virtually directly by means of the rotor.

Preference is also given to a drive unit in which the discharge opening is formed—as seen in the radial direction—by a recessed or projecting section of the circumferential wall of the housing. These are shapes that are very simple to create and that form the discharge opening, whereby, at the same time, the oil can be expelled in the direction of its main velocity component.

Particular preference is also given to a drive unit in which at least a third fluid path leading from the air environment of the housing to the motor compartment is provided. Ambient air can flow through this third fluid path into the motor compartment when the pump is partially submerged, and especially the at least one third path is in fluid connection with the ambient air. If oil is expelled via the second fluid path, an oil-air mixture is ultimately established in the motor compartment. Considerably less splash loss occurs here than if the motor compartment is filled with oil.

Preference is also given to a drive unit that is characterized in that the third fluid path has an opening in the circumferential wall of the housing. This constitutes an especially simple configuration of the third fluid path whose construction is not very complicated. The third fluid path can also preferably comprise a snorkel if the pump with the opening encompassed by the third fluid path is arranged below the oil surface. The snorkel protrudes above the oil surface into the air environment.

Preference is also given to a drive unit that is characterized in that the first fluid path runs via a bearing of a drive shaft and via a bypass opening through which the motor compartment is in fluid connection with a space that surrounds the drive shaft. In this case, oil being conveyed by the pump can get into the motor compartment via a bearing of the drive shaft and via the bypass opening, a process for which there is no need to provide a separate fluid connection. In other words, leakage oil that is present anyway in the vicinity of the bearing is advantageously utilized to cool and lubricate the drive unit.

Furthermore, preference is given to a drive unit that is configured as an electric motor. This motor comprises a stator. This stator interacts with the rotor in a familiar manner.

Finally, preference is also given to a drive unit that is characterized in that the rotor surrounds the stator as an external rotor. This has the advantage that the rotor—as seen in the radial direction—is configured as far as possible on the outside and as close as possible to a circumferential wall of the housing, so that it can expel the oil directly via the at least one second fluid path.

The envisaged objective is also achieved in that a pump, especially a submersible oil pump, is created. This pump is characterized by a drive unit of the present invention described above. Splash losses of the motor are considerably reduced as a result of the fact that the drive unit of the pump is provided with at least one second fluid path leading from the motor compartment to the air environment of the housing, thus allowing oil to be expelled from the motor compartment by the rotor.

BRIEF DESCRIPTION OF THE DRAWINGS

The invention will be explained in greater detail below on the basis of the drawing. The following is shown.

DETAILED DESCRIPTION

Figure 1:
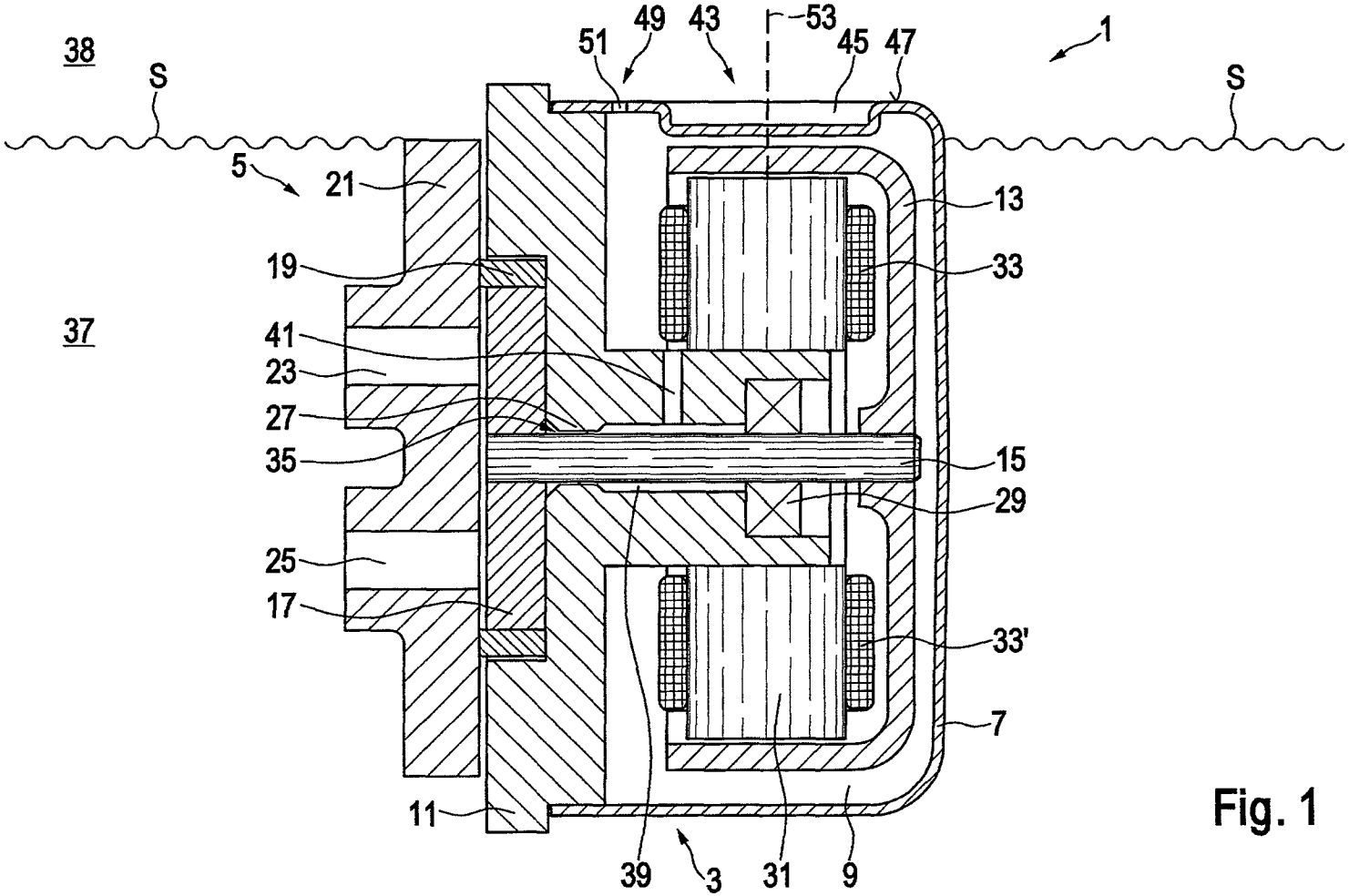
FIG. 1 a schematic longitudinal section of an embodiment of a pump with a drive unit.

FIG. 1 shows a schematic view of a longitudinal section of an embodiment of a pump 1. This pump comprises a drive unit 3 and a pump unit 5. The drive unit 3 and the pump unit 5 are preferably configured integrally. This means that they form a structural unit, as a result of which the pump 1 constitutes a module.

The drive unit 3 comprises a housing 7 which, in the embodiment shown, is configured so as to be pot-shaped. It surrounds a motor compartment 9. An open side of the pot-shaped housing 7 is closed by a support 11 that supports the pump unit 5. Here, it is depicted with a lid that tightly seals the housing 7.

A rotor 13 is arranged in the motor compartment 9. The rotor 13 is joined to a drive shaft 15 which, in turn, is joined to the pump unit 5. In this manner, the rotor 13 brings about a rotational movement of the rotatable parts of the pump unit 5 around a longitudinal axis of the drive shaft 15 during operation of the pump 1. Whenever the term "axial direction" is employed, this always refers to the direction of the longitudinal axis of the drive unit 15. The radial direction refers to the direction that is perpendicular thereto.

The pump 1 is configured here as a gerotor pump. Consequently, in the embodiment shown, the pump unit 5 comprises an inner gearwheel 17 that meshes with an outer gearwheel 19. Moreover, the pump unit 5 has a closure lid 21. This lid 21 closes the actual pump area with the inner gearwheel 17 and the outer gearwheel 19. It also has an inlet area 23 and an outlet area 25, whereby, via the inlet area 23, oil can get into the actual suction area that is formed by the inner gearwheel 17 and the outer gearwheel 19. Oil is expelled through the outlet area 25 via a pressure area that is formed by the gearwheels. In this manner, the pump unit 5 conveys oil from the inlet area 23 to the outlet area 25. The principle of a gerotor pump is well known, so that this will not be elaborated upon here.

In other embodiments, it is possible for the pump not to be configured as a gerotor pump. It can be configured for instance, as a rotary vane pump, a radial piston pump or else in some other suitable manner.

The drive shaft 15 is joined to the inner gearwheel 17, so that it is driven by the rotor 13. In this context, the drive shaft 15 is mounted in a first bearing 27 and preferably in a second bearing 29. Preferably, the first bearing 27 is configured as a sliding bearing. The second bearing 29 is preferably configured as a ball bearing, especially preferably as a deep-groove ball bearing.

In the embodiment shown, the drive unit 3 is configured as an electric motor that comprises a stator 31. In particular, FIG. 1 depicts the stator windings 33, 33'. Preferably, the drive unit 3 is configured as a synchronous electric motor, especially preferably as a brushless direct-current electric motor (BLDC motor), very particularly preferably as a sensorless BLDC motor. In this case, the rotor 13 is configured as a permanent magnet, or else it has sections that comprise permanent-magnetic material. The principle of an electric motor, especially of a synchronous or BLDC motor, is familiar, so that this will not be elaborated upon here.

Especially preferably, the stator and the rotor are positioned and/or configured in such a way that the bearing 29 is pretensioned. In particular, between the stator 31 and the rotor 13, there is preferably a magnetic that forces the rotor 13 towards the left in FIG. 1, as a result of which the drive shaft 15 is also forced to the left. In this manner, a force is exerted onto the bearing 29 that acts in the axial direction and pretensions it. This is especially advantageous if the bearing is configured as an axial ball bearing. The pretensioning translates into a high level of stiffness, quiet running, a more precise guidance of the drive shaft 15 as well as a compensation for wear and settling processes in the bearing 29. Altogether, this accounts for a longer service life for the bearing 29.

A first fluid path 35 leads from a submerged-oil environment 37 of the housing 7 to the motor compartment 9. The submerged-oil environment is located below the oil surface S, whereby, in the embodiment shown, the pump is partially submerged below the oil surface. The fluid path 35 leads through the first bearing 27—which, depending on the viscosity of the oil, has a certain rate of leakage—into a space 39. In the embodiment shown, it surrounds the drive shaft. Moreover, as seen in the axial direction, it is delimited by the first bearing 27 and preferably by the second bearing 29. Altogether, the space 39 here forms an annular space around the drive shaft 15. The support 11 has a bypass opening 41 via which the motor compartment 9 is in fluid connection with the space 39. The bypass opening 41 can preferably be configured as a drilled hole. Finally, the oil leaves the submerged-oil environment 37 of the pump 1 or of the housing 7 via the inlet area 23 and via the suction area formed by the inner gearwheel 17 and the outer gearwheel 19 and, via the first bearing 27, the oil reaches the space 39 and from there, goes to the motor compartment 9 via the bypass opening 41. From the suction area that is formed by the gearwheels 17, 19, the oil inside the pump reaches the pressure area that is in fluid connection with the outlet area 25. The pressure area of the pump is likewise adjacent to the first bearing 27. It is precisely from the pressure area of the gearwheels 17, 19 where the oil is under an elevated pressure, that the oil, as leakage oil, reaches the space 39 through the bearing 27.

Therefore, all in all, the first fluid path 35 comprises the inlet area 23, the suction area and especially also the pressure area of the gearwheels 17, 19, the leakage path through the bearing 27, the space 39 as well as the bypass opening 41. Thus, during operation and when the pump 1 is at a standstill, oil from the submerged-oil environment 37 reaches the motor compartment 9 via the first fluid path 35, where it is available to cool the drive unit 3.

The flow rate of the oil along the first fluid path depends on the viscosity of the oil and thus especially on its temperature. If the oil heats up, for example, due to exhaust heat from the drive unit 3, the viscosity drops and more oil per unit of time can pass through the fluid path. In other words, more oil will be conveyed to the drive unit 3 or to the motor compartment 9 if the oil is hotter. This advantageously causes the drive unit 3 to be cooled as a function of the temperature. The hotter it becomes, the more oil is conveyed via the first fluid path 35 for cooling purposes, so that more heat can thus be dissipated.

However, when the pump 1 is at least partially submerged into the oil, during a standstill, the motor can fill up with oil via the first fluid path 35 and, if applicable, also via additional holes drilled into the housing 7. When the pump is started up again, the rotor 13 then rotates inside the motor compartment 9 that is completely filled with oil, a process in which the drag torque of the oil causes considerable losses, so-called splash losses, to occur.

In order to prevent this, the drive unit in question here is provided with at least one second fluid path 43 leading from the motor compartment 9 to an air environment 38 that is situated above the oil surface S. The second fluid path 43 is configured and/or arranged in such a way that the rotor 13 can expel oil from the motor compartment. In this process, as the rotor 13 turns, it accelerates the oil adhering to it, which is then expelled via the second fluid path 43.

Preferably, the second fluid path 43 is provided in certain areas of a circumferential wall 47 of the housing 7. The centrifugal force exerted by the rotating rotor 13 accelerates the oil especially in the radial direction and oil that has been picked up in the tangential direction is expelled very efficiently via the second fluid path 43.

Preferably, the second fluid path 43 comprises a discharge opening 45 that is provided in the circumferential wall 47 of the housing 7.

Preferably, more than one second fluid path 43 is provided. It is possible that—as seen in the circumferential direction—at least two, preferably more, discharge openings 45 are provided in the circumferential wall 47. In this context, the discharge openings 45 are situated either above the oil surface S, or else they are connected to at least one snorkel that protrudes above the oil surface S, so that the second fluid path 43 leads to the air environment 38 in any case.

Preferably, it is provided that the passage cross section of the one second fluid path 43, or the cumulative passage cross section of the various second fluid paths, is greater than the passage cross section of the first fluid path 35. In this case, more oil is expelled per unit of time by the rotor 13 than can be replenished via the first fluid path 35. Consequently, a motor that has filled up while at a standstill empties out quickly when it is started up again, so that splash losses are limited to a brief period of time after the start-up. Here, the passage cross section of the first fluid path 35 only has to be large enough that it can convey into the motor compartment 9 a sufficient quantity of oil to cool the drive unit 3.

Depending on whether air can continue to flow into the motor compartment 9, an oil-oil vapor mixture or an oil-air mixture is present in said motor compartment 9. However, especially transmission oil typically contains a large quantity of air or air bubbles dissolved in the oil, so that in this case, air is released when the oil is being expelled, even if no ambient air is being replenished. Then, too, an oil-air mixture, if applicable at a negative pressure, is present.

Especially when parts of the pump are submerged deep into the oil, preferably at least one third fluid path 49 is provided that leads from the air environment 38 to the motor compartment 9, especially preferably through a snorkel. Additional ambient air can then flow into the motor compartment 9 via this third fluid path when the oil is expelled via the second fluid path 43. For this purpose, the third fluid path is preferably in fluid connection with the air environment 38. Towards this end, as already mentioned, it is possible for the appertaining area of the pump 1 that has the third fluid path 49 not to be submerged in the oil. However, it is likewise possible for the third fluid path 49 to have a snorkel that protrudes above the oil surface S if the pump 1 is completely submerged or when at least parts of the pump are submerged deep into the oil.

Especially preferably, the third fluid path 49 has an opening 51 in the circumferential wall 47. Preferably, additional air can then flow in if the pump with the opening 51 is protruding out of the oil, or if a snorkel that protrudes out of the oil is provided in or at the opening 51.

In the present embodiment, the rotor 13 surrounds the stator 31 as an external rotor. This is particularly advantageous since, in this way, oil adhering to the rotor 13 is accelerated over a large radius and in the direct vicinity of the discharge opening 45, so that it can easily be expelled.

FIG. 1 shows a broken line 53 that runs in the radial direction and that is perpendicular to the circumferential wall 47 and that indicates the intersection area of the sectional views in FIG. 2.

Figure 2A:
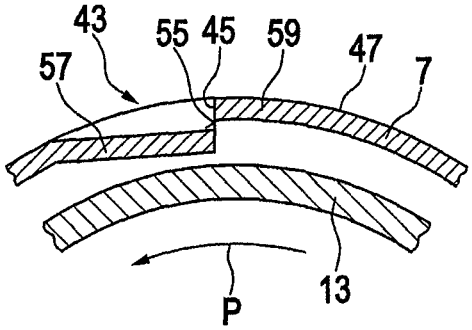
FIG. 2*a* a schematic detailed view of a cross section of the drive unit according to FIG. 1.

FIG. 2*a* shows a detailed view of the pump 1, namely, a section from a cross-sectional view, whereby the intersection plane in FIG. 1 is arranged at the height of line 53. Identical and functionally equivalent elements are provided with the same reference numerals, so that reference is hereby made to the preceding embodiments. Particularly the rotor 13 as well as the housing 7 with its circumferential wall 47 are shown.

An embodiment of the discharge opening 45 in the second fluid path 43 is described on the basis of FIG. 2*a*. In particular, FIG. 2*a* shows how the discharge opening 45 can be configured in order to allow an efficient discharge of oil from the motor compartment 9 by the rotor 13, preferably at a high discharge speed.

In the embodiment shown, the discharge opening 45 has a special shape: it has a passage surface 55 that is arranged essentially perpendicular—here precisely perpendicular—to an imaginary circumferential line in the direction of rotation of the rotor 13. This is indicated in FIG. 2*a* by the arrow P. The rotation of the rotor 13 is concentric to the longitudinal axis of the drive shaft 15. Therefore, it is possible to construct circumferential lines that run concentrically to the longitudinal axis of the drive shaft 15 and thus, so to speak, represent circumferential lines of the rotational direction of the rotor 13. At its intersection point with at least one such circumferential line, the passage surface 55 runs essentially—here precisely—perpendicular thereto. Oil adhering to the rotor 13 is imparted by the rotor with a main velocity component that is oriented essentially tangentially to the rotational direction of the rotor 13 or to a corresponding circumferential line. Owing to the fact that the passage surface 55 is arranged essentially perpendicular to an imaginary circumferential line in the direction of rotation of the rotor 13, the oil can exit from the discharge opening 45 in the direction of its main velocity component without being hindered. In other words, the passage surface 55 is arranged or shaped in such a way that oil can be expelled by the rotor 13 very efficiently.

Especially preferably, the discharge opening 45 is formed by a section 57 of the circumferential wall 47 which is recessed as seen in the radial direction. Together with a section 59 of the circumferential wall 47 which—as seen in the direction opposite from the rotational direction of the rotor 13—adjoins the recessed section 57 and itself is not recessed, the discharge opening 45 is easy to create. For instance, it can be stamped into the housing.

It is particularly advantageous for the rotor 13 to have an outer diameter that is only slightly smaller than the inner diameter of the housing 7. In this case, only a relatively small volume of oil is situated between the rotor 13 and the circumferential wall 47, and this oil volume can be accelerated by the rotor 13 virtually in its entirety. Especially preferably, the recessed section 57 is recessed to such an extent—as seen in the radial direction—that the passage surface 55 takes up a large portion of the surface area available between the circumferential wall 47 and the rotor 13. In this case, a considerable amount of the oil situated between the rotor 13 and the circumferential wall 47 can be expelled via the passage surface 55. In this context, the closer the recessed section 57—as seen in the radial direction—is to the rotor 13, the more it can scrape off oil that is in effect adhering to the rotor 13, so that said oil is then expelled.

Figure 2B:
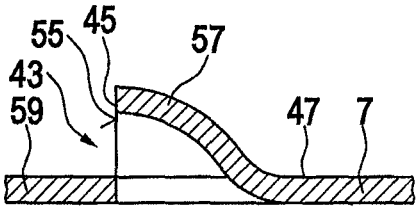
FIG. 2*b* a schematic detailed view of a cross section of another embodiment of a discharge opening.

FIG. 2*b* shows a schematic detailed view of the cross section of another embodiment of a discharge opening 45. Identical and functionally equivalent elements are provided with the same reference numerals, so that reference is hereby made to the preceding elaborations. The discharge opening 45 here is formed by a section 57 of the circumferential wall 47 which protrudes as seen in the radial direction. Together with a section 57 of the circumferential wall 47 which adjoins the recessed section 57 and itself does not protrude, the discharge opening 45 is easy to create. For instance, it likewise can be stamped into the housing.

As already mentioned, preferably more than one discharge opening 45—as seen in the circumferential direction—is arranged in the vicinity of the circumferential wall 47. In this context, they are either situated above the oil surface S or they are at least connected to a snorkel that protrudes above the oil surface S.

Altogether, it can be seen that, with the present drive unit and the present pump, considerable less splash loss occurs and thus a considerable better efficiency is achieved due to the second fluid path that allows oil to be expelled from the motor compartment 9 by the rotor 13. This reduces the drive power consumed, so that the drive unit and the pump are quite economical.

LIST OF REFERENCE NUMERALS

1 pump
3 drive unit
5 pump unit
7 housing
9 motor compartment
11 support
13 rotor
15 drive shaft
17 internal gearwheel
19 external gearwheel
21 closure lid
23 inlet area
25 outlet
27 sliding bearing
29 ball bearing
31 stator
33 stator winding
35 fluid path
37 submerged-oil environment
38 air environment
39 space
41 bypass
43 fluid path
45 discharge opening
47 circumferential wall
49 fluid path
51 opening
53 line
55 passage surface
57 section
59 section
33' stator winding
P arrow
S oil surface

What is claimed is:

1. A drive unit for a submersible oil pump, comprising
a housing surrounding a motor compartment;
a rotor arranged in the motor compartment,
a first fluid path leading from a submerged oil environment of the housing to the motor compartment so as to allow oil to flow from the submerged oil environment into the motor compartment;
at least one second fluid path leading from the motor compartment to an air environment of the housing and allowing oil to be discharged to the air environment from the motor compartment by the rotor; and
at least one third fluid path leading from the air environment of the housing to the motor compartment, whereby ambient air can flow through the third fluid path into the motor compartment when oil is expelled via the second fluid path.

2. The drive unit as recited in claim 1 wherein the second fluid path comprises a discharge opening arranged in a circumferential wall of the housing.

3. The drive unit as recited in claim 2 wherein the discharge opening has a passage surface arranged perpendicular to an imaginary circumferential line in the direction of rotation of the rotor.

4. The drive unit as recited in claim 2 wherein the discharge opening is formed—as seen in the radial direction—by a recessed or projecting area of the circumferential wall of the housing.

5. The drive unit as recited in claim 1 wherein the third fluid path has an opening in the circumferential wall of the housing.

6. The drive unit as recited in claim 1 wherein the first fluid path runs via a bearing of a drive shaft and via a bypass opening via which the motor compartment is in fluid connection with a space surrounding the drive shaft.

7. The drive unit as recited in claim 1 further comprising a stator so as to define an electric motor.

8. The drive unit as recited in claim 7 wherein the rotor surrounds the stator as an external rotor.

9. A pump comprising the drive unit as recited in claim 1.

10. A submersible oil pump comprising the pump as recited in claim 9.

* * * * *